US008991343B2

(12) United States Patent
Hoppe et al.

(10) Patent No.: US 8,991,343 B2
(45) Date of Patent: Mar. 31, 2015

(54) CAMSHAFT ADJUSTING DEVICE

(75) Inventors: Jens Hoppe, Erlangen (DE); Markus Kinscher, Adelsdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 88 days.

(21) Appl. No.: 13/579,966

(22) PCT Filed: Jan. 25, 2011

(86) PCT No.: PCT/EP2011/050975

§ 371 (c)(1),
(2), (4) Date: Aug. 20, 2012

(87) PCT Pub. No.: WO2011/104057

PCT Pub. Date: Sep. 1, 2011

(65) Prior Publication Data

US 2012/0312262 A1 Dec. 13, 2012

(30) Foreign Application Priority Data

Feb. 23, 2010 (DE) ..... 10 2010 008 931

(51) Int. Cl.
*F01L 1/34* (2006.01)
*F16B 7/20* (2006.01)
*F01L 1/344* (2006.01)

(52) U.S. Cl.
CPC ..... *F01L 1/3442* (2013.01); *F01L 2001/34426* (2013.01); *F01L 2001/3443* (2013.01); *F01L 2001/34433* (2013.01); *F01L 2103/00* (2013.01)
USPC ..... 123/90.17; 403/349

(58) Field of Classification Search
USPC ..... 123/90.15, 90.17; 403/348–349
See application file for complete search history.

(56) References Cited

U.S. PATENT DOCUMENTS

| | | | | |
|---|---|---|---|---|
| 6,971,353 | B2 * | 12/2005 | Heinze et al. | 123/90.17 |
| 7,021,256 | B2 * | 4/2006 | Wagner et al. | 123/90.11 |
| 2005/0126874 | A1 * | 6/2005 | Back et al. | 192/3.3 |
| 2006/0071560 | A1 * | 4/2006 | Ermert et al. | 310/14 |
| 2008/0271690 | A1 * | 11/2008 | Bayrakdar | 123/90.17 |
| 2013/0039697 | A1 * | 2/2013 | Plankl et al. | 403/349 |

FOREIGN PATENT DOCUMENTS

| | | | |
|---|---|---|---|
| CN | 1711438 | | 12/2005 |
| DE | 10211467 | | 9/2003 |
| DE | 10238840 | | 3/2004 |
| DE | 10252431 | | 5/2004 |
| DE | 102006031517 | | 1/2008 |
| DE | 102007019923 | | 10/2008 |
| DE | 102009020652 | | 11/2010 |
| EP | 2073223 | | 6/2009 |
| EP | 2276330 | A2 * | 1/2011 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

A camshaft adjusting device (1) for varying the relative angular position of a camshaft in relation to a crankshaft of an internal combustion engine, wherein the camshaft adjusting device (1) includes an actuator (2) for actuating a hydraulic valve, wherein the actuator (2) is fastened to a housing element (4) by a fastening element (3), and wherein the actuator (2) has an axis (5) which in the mounted state of the actuator (2) is concentric to an axis of the camshaft adjusting device (1). In order to simplify mounting of the actuator on the camshaft adjusting device, on the outer face (6) facing away from the camshaft adjusting device (1) the actuator (2) includes a grip section (7) having a configuration that is not rotationally symmetrical to the axis (5).

7 Claims, 5 Drawing Sheets

CAMSHAFT ADJUSTING DEVICE

FIELD OF THE INVENTION

The present invention relates to a camshaft adjusting device for changing the relative angular position of a camshaft relative to a crankshaft of an internal combustion engine, wherein the camshaft adjusting device comprises an actuator for activating a hydraulic valve, wherein the actuator is attached to a housing element by an attachment means, and wherein the actuator has an axis that is concentric to an axis of the camshaft adjusting device in the installed state of the actuator.

BACKGROUND

Camshaft adjusters of this class are used for changing the relative angular position of the camshaft relative to the crankshaft of an internal combustion engine. Here, the adjusting device comprises a drive element that is driven by the crankshaft via a gear and is supported so that it can rotate relative to the camshaft, wherein at least two hydraulic chambers are formed between the drive element and the camshaft and these hydraulic chambers can be pressurized with a pressurized fluid, in order to set a defined relative rotational position between the drive element and the camshaft.

The pressurized fluid is controlled with hydraulic valves. For central valve systems, an actuator in the form of a central magnet is mounted coaxial to the camshaft by a flange separated from the associated hydraulic system in a position-fixed structure of the motor (housing element, e.g., the timing gear cover). Current is fed into a coil of the electromagnet by a connector. The magnetic field induced in this way is transmitted to a moving magnetic armature via a soft iron core consisting of a yoke, yoke plate, magnetic housing, and pole core. It exerts a magnetic force on the armature in the direction of the gap reduction across a working air gap between the pole core and the armature. This magnetic force is transmitted to a piston of the central valve via a pressure pin. The volume flow of the pressurized fluid to the camshaft adjuster is changed by the displacement of the piston.

The actuator of the camshaft adjuster is attached to the housing element in the prior art usually by a screw connection. Such solutions are disclosed, for example, in DE 102 11 467 A1, DE 10 2007 019 923 A1, and DE 10 2006 031 517 A1.

A screw-less fastening of the actuator on the housing element has also become known, as mentioned in passing in DE 102 52 431 A1. A bayonet mount can be used here to fix the actuator on the housing element. In this case, the actuator that is to be mounted concentric to the axis of the camshaft adjuster is mounted by a rotational movement after which it is inserted into a corresponding handle section of the bayonet mount.

A disadvantage in this procedure is that it sometimes difficult for the installer to perform the rotational or pivoting movement, because this must be performed with a certain, not insignificant torque produced by the requirement for a fixed seating of the actuator in the installed state and the required fitting tolerances between the actuator and housing element.

SUMMARY

The present invention is based on the objective of improving a camshaft adjusting device of the type noted above such that the mentioned disadvantage can be avoided. Accordingly, a construction is proposed through which the installation of the actuator on the camshaft adjuster can be simplified, i.e., is easier to perform.

This objective is met by the invention being characterized in that the actuator has, on its outside facing away from the camshaft adjusting device, a handle section with a shape that is not rotationally symmetric to the axis.

The attachment means are here preferably constructed as a screw-free fastening element; in particular, a bayonet mount is envisioned as the attachment means.

The handle section can have polygonal contours. These polygonal contours are preferably arranged about the axis. The handle section is provided, in an especially preferred way, with quadrilateral, pentagonal, hexagonal, heptagonal, or octagonal contours.

The handle section can alternatively also have a vane-like structure with two handle sections.

Furthermore, the handle section could have a pair of knobs with two handle sections.

The outside of the actuator together with the handle section is preferably formed by an injection-molded housing element. An electric connector can be integrated into the housing element.

Through the proposed solution, it is much easier for an installer to attach the actuator onto the camshaft adjuster housing. The required torque to be applied here by hand can be generated much more easily by the proposed handle section. The mentioned handle section on the outside of the actuator in the form of polygonal contours can also be constructed alternatively as a vane or as a pair of knobs. The decisive factor is the ability to apply a pair of forces onto the outside of the actuator via the palm, the fingers, and the thumbs.

BRIEF DESCRIPTION OF THE DRAWINGS

In the drawings, an embodiment of the invention is shown. Shown are.

DETAILED DESCRIPTION OF THE PREFERRED EMBODIMENTS

Figure 1:
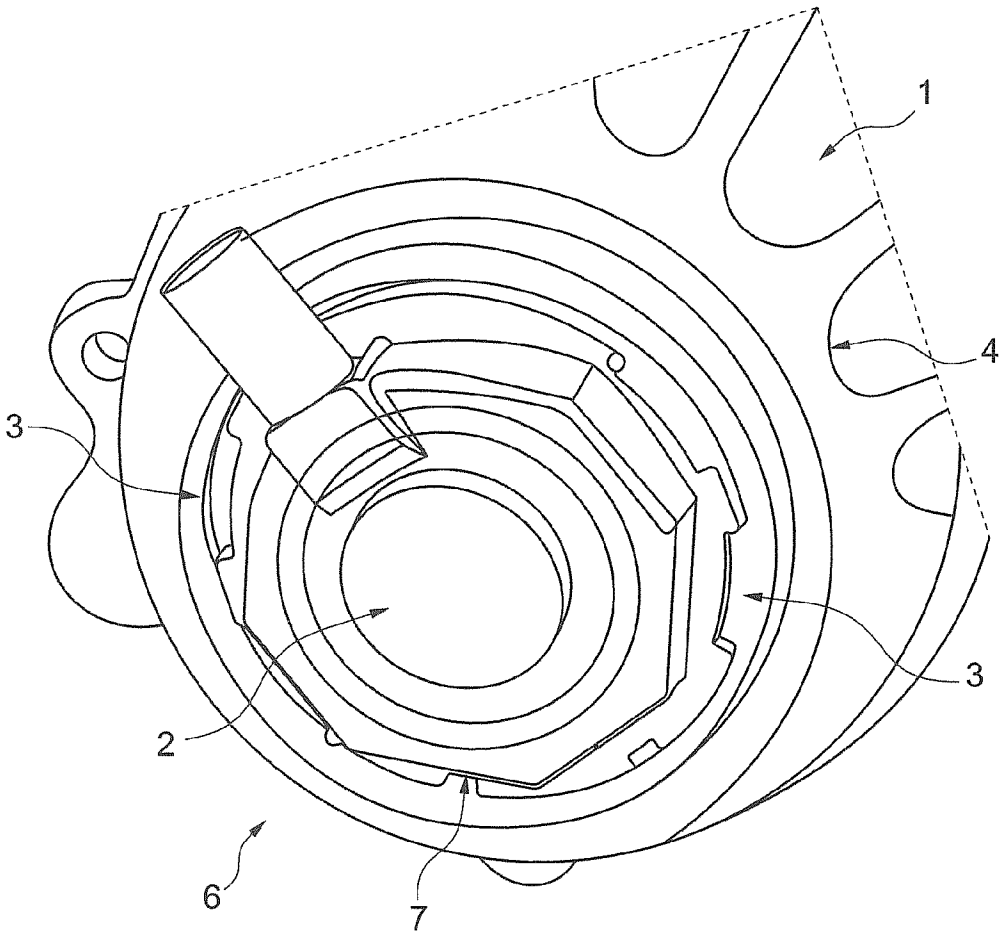
FIG. 1 in perspective view, the end region of a camshaft adjuster in which an actuator for actuating a hydraulic valve is mounted, FIG. 2 the actuator in a radial section view, FIG. 3 the actuator in a perspective view, seen from a first direction, FIG. 4 the actuator in a perspective view, seen from a second direction.

In FIG. 1, a camshaft adjusting device 1 is sketched, with only a part of this device being visible, namely one axial end region. In this region, an actuator 2 is arranged that is used for adjusting a hydraulic valve.

The camshaft adjusting device 1 is here constructed according to the construction with a central magnet and central valve for the adjustment, as described in DE 102 52 431 A1 of the applicant; this document is referenced explicitly. The actuator 2 is attached to a housing element 4 of the camshaft adjusting device 1.

Figure 2:
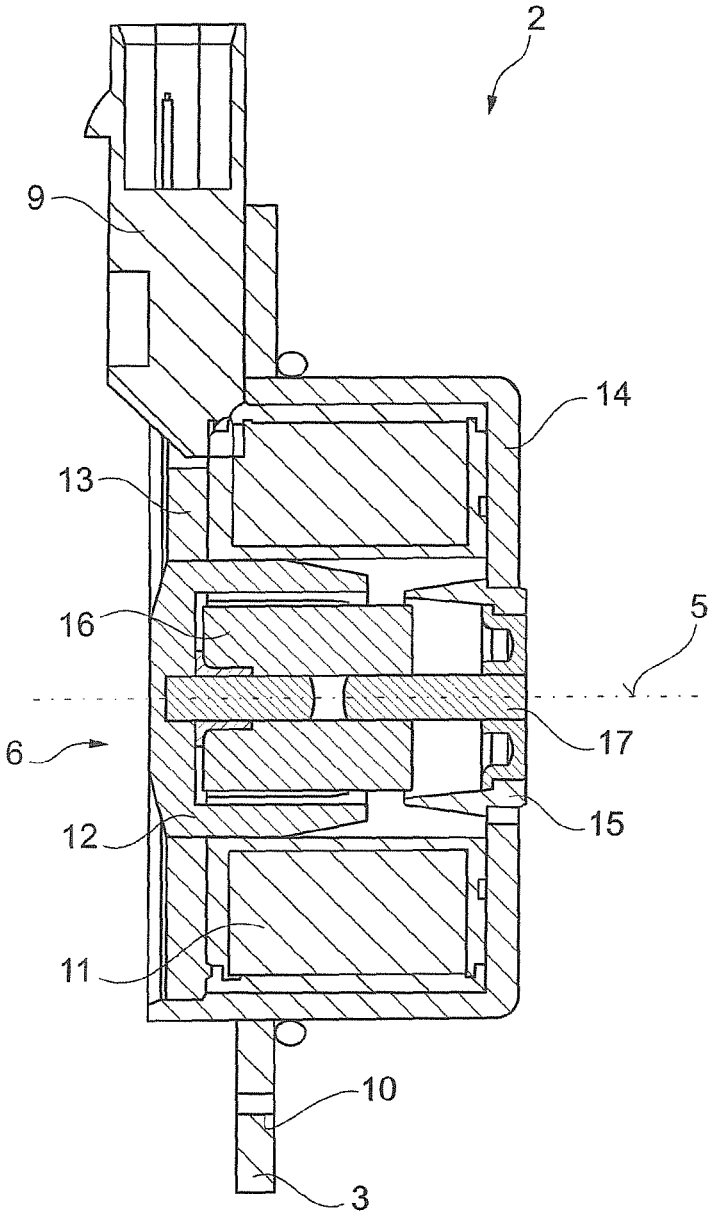

Details can be taken from FIG. 2. In the central valve application to be seen here for the camshaft adjusting system, a magnet is mounted in a position fixed structure of the engine (e.g., in the timing gear cover) coaxial to the camshaft by a flange 10 separately from the associated hydraulic system. Current is fed into a coil 11 via an electric connector 9. The magnetic field induced in this way is transmitted to the moving magnetic armature 16 via a soft iron core consisting of yoke 12, yoke plate 13, magnetic housing 14, and pole core 15. The magnetic field exerts a magnetic force on the magnetic armature 16 in the direction of the gap reduction across a working air gap between the pole core 15 and the magnetic armature 16. This magnetic force is transmitted by a pressure pin 17 onto the piston of a (not shown) hydraulic central valve.

The displacement of the piston changes the hydraulic volume flows in the camshaft adjuster and thus rotates the camshaft relative to the crankshaft in a known way.

The actuator 2 on the housing element 4 of the camshaft adjusting device 1 is attached in the present case by a bayonet mount ("tank cover closure"), i.e., the attachment means 3 with which the actuator 2 is attached to the housing element 4 is constructed as a screw-free connecting means. In FIG. 1, cut regions 3 are to be seen that are constructed for placement in corresponding (not shown) projections extending outward in the radial direction on the housing element 4; rotating the actuator 2 about the axis 5 (see FIG. 2) closes the bayonet mount and fixes the actuator 2 on the housing element 4.

Figure 3:
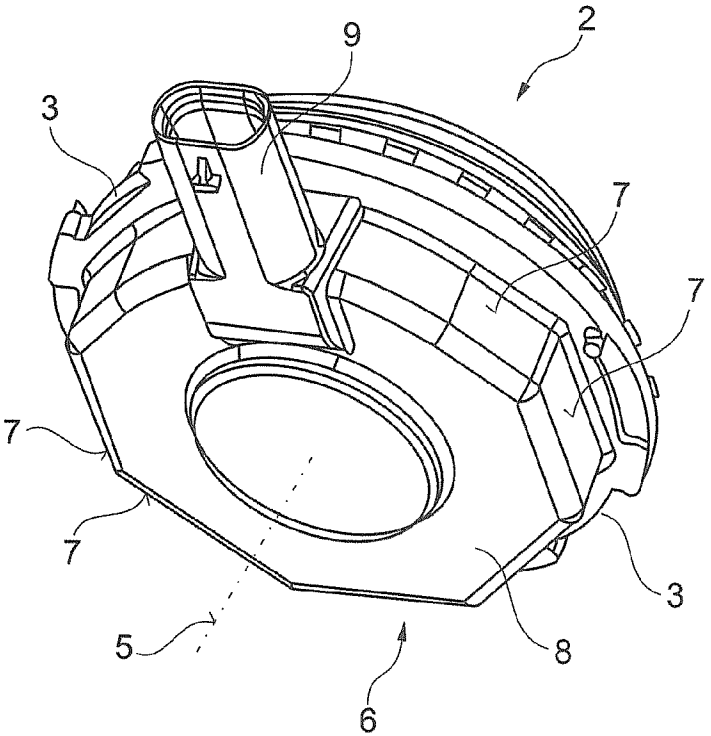
Figure 5:
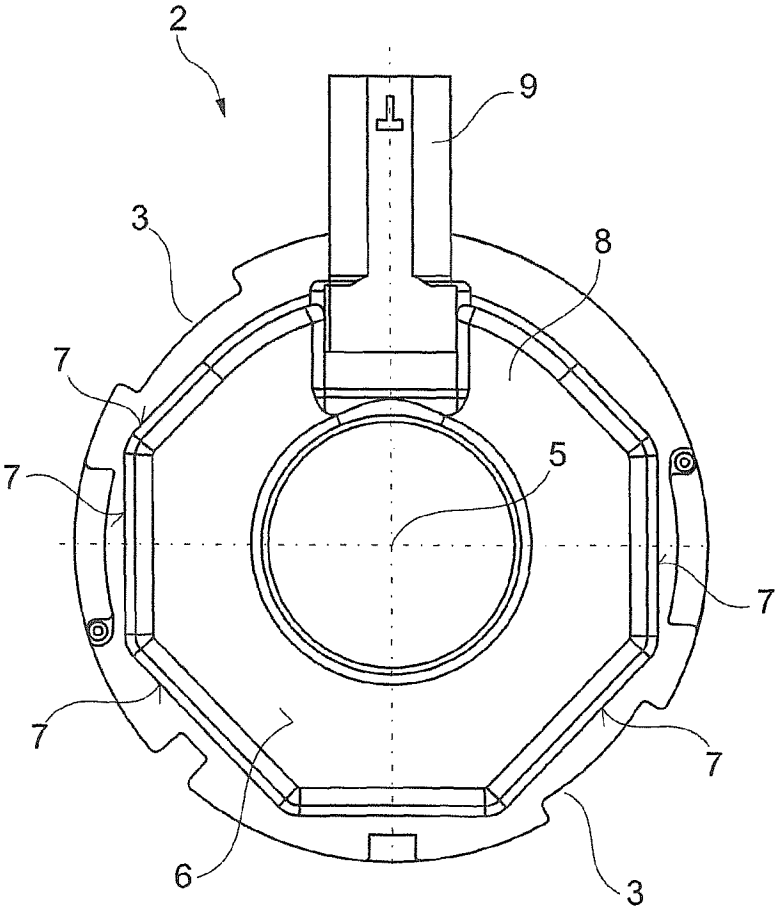
FIG. 5 the actuator in a front view.

So that the installer can apply the required torque by hand without a problem onto the actuator 2 during the process of attaching the actuator 2 on the housing element 4, it is provided that the actuator 2 has a handle section 7 with a shape that is not rotationally symmetric to the axis 5 on its outside 6 facing away from the camshaft adjusting device 1, as can be seen, in particular, in FIGS. 3 and 5.

Accordingly, the outside 6 of the actuator 2 does not have a rotationally symmetric construction (apart from the electrical connector 9 that is otherwise not suitable for applying a torque), but instead has handle-like contours.

In the embodiment, the handle section 7 is provided with octagonal contours, so that contact surfaces can be found for the thumbs and fingers of the installer's hand, in order to turn the actuator 2 during installation about the axis 5, wherein in this way the hand of the installer finds a good grip, so that it cannot slip.

Figure 4:
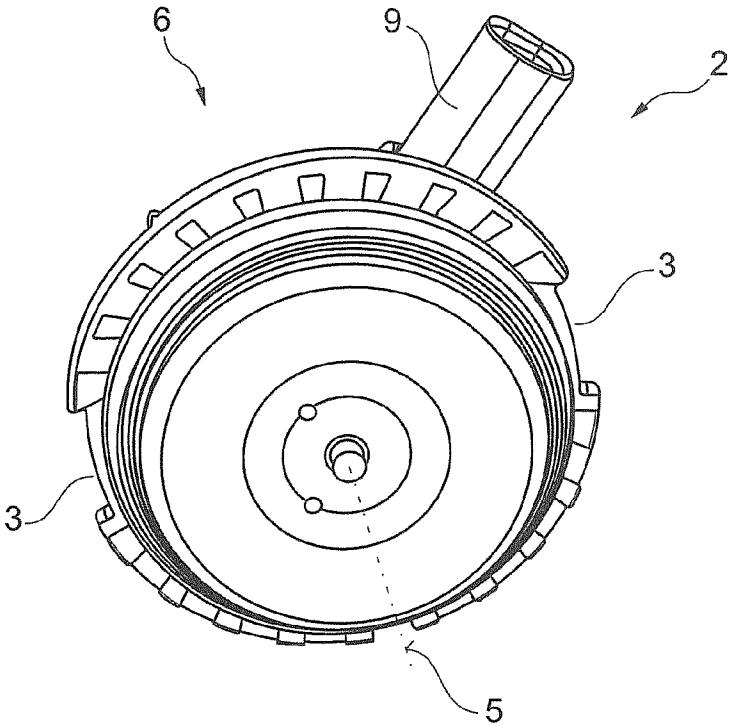
Figure 7:
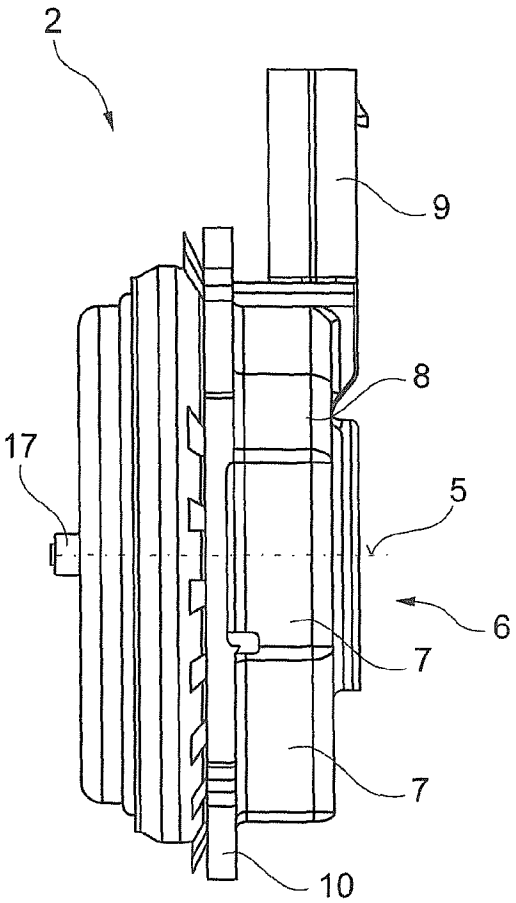
FIG. 7 the actuator in a side view.
Figure 6:
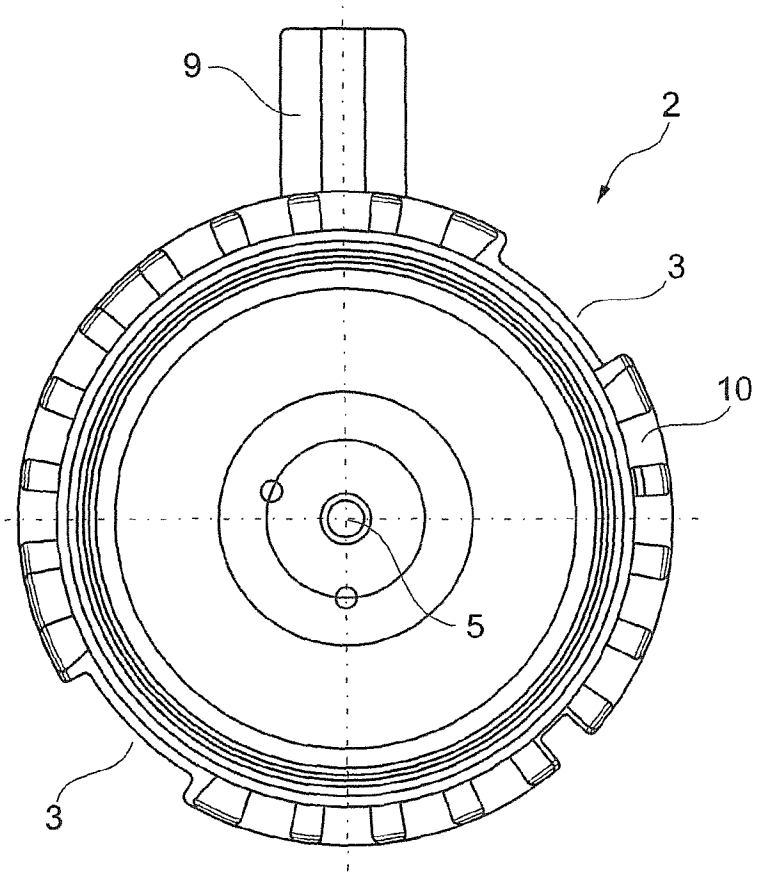
FIG. 6 the actuator in a rear view.

In FIGS. 3 to 7, the actuator 2 is to be seen as a separate component in different views (in FIG. 3: the front side in a perspective diagram; in FIG. 4: the rear side in a perspective diagram; in FIG. 5: the view in the axial direction 5 seen from the front; in FIG. 6: the view in the axial direction 5 seen from the rear; in FIG. 7: the side view). In FIGS. 3 and 5, the construction of the handle section 7 as octagonal contours can be seen in an especially good way.

The construction of a housing element 8 of the actuator 2 as a completely insert-molded component is preferred in which the connector 9 or at least its projection is also integrated. In the injection molding of the housing element 8, the handle section 7 is formed accordingly.

LIST OF REFERENCE SYMBOLS

1 Camshaft adjusting device
2 Actuator
3 Attachment means
4 Housing element
5 Axis
6 Outside
7 Handle section
8 Housing element
9 Electric connector
10 Flange
11 Coil
12 Yoke
13 Yoke plate
14 Magnetic housing
15 Pole core
16 Magnetic armature
17 Pressure pin

The invention claimed is:

1. Camshaft adjusting device for changing a relative angular position of a camshaft relative to a crankshaft of an internal combustion engine, the camshaft adjusting device comprises an actuator for activating a hydraulic valve, the actuator is attached by an attachment element to a housing element, and the actuator has an axis that is concentric to an axis of the camshaft adjusting device in an installed state of the actuator, the actuator has a handle section with a shape having polygonal contours that is not rotationally symmetric relative to the axis of the actuator on an outside thereof facing away from the camshaft adjusting device, wherein the polygonal contours are arranged around a periphery of the handle section and the polygonal contours are defined by a plurality of substantially straight portions that are connected to each other end-to-end.

2. Camshaft adjusting device according to claim 1, wherein the attachment element is a screw-free attachment element.

3. Camshaft adjusting device according to claim 2, wherein the attachment element comprises a bayonet mount.

4. Camshaft adjusting device according to claim 1, wherein the polygonal contours are arranged around the axis of the actuator.

5. Camshaft adjusting device according to claim 1, wherein the handle section has quadrilateral, pentagonal, hexagonal, heptagonal, or octagonal contours.

6. Camshaft adjusting device according to claim 1, wherein an outside of the actuator together with the handle section is formed as an injection-molded housing element.

7. Camshaft adjusting device according to claim 6, wherein an electrical connector is integrated in the injection-molded housing element.

* * * * *